US007912385B2

(12) United States Patent
Lim

(10) Patent No.: US 7,912,385 B2
(45) Date of Patent: Mar. 22, 2011

(54) IMAGE FORMING APPARATUS AND DEVELOPER LEVEL CALCULATING METHOD OF THE SAME

(75) Inventor: Young-kak Lim, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 177 days.

(21) Appl. No.: 12/264,451

(22) Filed: Nov. 4, 2008

(65) Prior Publication Data

US 2009/0136244 A1 May 28, 2009

(30) Foreign Application Priority Data

Nov. 22, 2007 (KR) ..... 10-2007-0119886

(51) Int. Cl.
*G03G 15/08* (2006.01)

(52) U.S. Cl. ..... 399/27

(58) Field of Classification Search ..... 399/27, 399/61, 258, 262; 347/140; 430/434
See application file for complete search history.

(56) References Cited

U.S. PATENT DOCUMENTS

| | | | | |
|---|---|---|---|---|
| 6,459,861 | B1 * | 10/2002 | Sakurai et al. | 399/27 |
| 6,591,070 | B1 * | 7/2003 | Shoji et al. | 399/27 |
| 7,218,871 | B2 * | 5/2007 | Ogata | 399/27 |
| 2006/0127108 | A1 * | 6/2006 | Okuyama et al. | 399/27 |

FOREIGN PATENT DOCUMENTS

JP 2004-354666 12/2004

* cited by examiner

*Primary Examiner* — Sandra L Brase
(74) *Attorney, Agent, or Firm* — Stanzione & Kim, LLP

(57) ABSTRACT

An image forming apparatus and a developer level calculating method of the same. The image forming apparatus includes a developing unit which includes a developing roller to provide the developer onto a photosensitive body, a developing sensor to sense a developer level, and a supplying roller to supply the developer to the developing roller; a developer bottle which supplies the developer to the developing unit; and a controller which calculates a number of first printing dots of the developing unit, converts the amount of the developer supplied from the developer bottle sensed by the developer sensor into a number of second printing dots, calculates a number of third printing dots on the basis of the number of the first printing dots and the second printing dots, and calculates total developer level of the developer bottle on the basis of the number of the third printing dots.

24 Claims, 7 Drawing Sheets

IMAGE FORMING APPARATUS AND DEVELOPER LEVEL CALCULATING METHOD OF THE SAME

CROSS-REFERENCE TO RELATED APPLICATIONS

This application claims priority from Korean Patent Application No. 10-2007-0119886, filed on Nov. 22, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus and a developer level calculating method of the same, and more particularly, to an image forming apparatus which includes a developer bottle to supply a developer and a developer level calculating method of the same.

2. Description of the Related Art

In general, an image forming apparatus scans a beam onto a photosensitive body electrified to a predetermined electric potential to form an electrostatic latent image corresponding to image data, develops the electrostatic latent image into a visible image by using a developer, and transfers and fuses the developed image on a printing medium to form an image thereon.

The image forming apparatus includes a developing unit which supplies a developer onto the photosensitive body, and may include a variety of methods so as to compliment a developer in the developing unit. Among these methods is known a method in which a developer bottle which contains a developer is separately provided to supply the developer to the developing unit.

In a conventional image forming apparatus, a developer level inside the developing unit is displayed to a user after image data is printed so that the user can predict a replacing time of the developing unit and determine the amount of image data to apply a printing signal. For this purpose, in the conventional image forming apparatus, the number of reference printing dots capable of printing per reference developer capacity is preset, and a developer level on the basis of the number of the reference printing dots is calculated.

However, even though the developer level is displayed being left to the user on the basis of the number of the printing dots, in reality there may be insufficient developer left inside the developing unit, thereby causing a problem that printing suddenly stops before completion of printing an image.

That is, as illustrated in FIG. 1, since the inclination of a first graph A in which a developer level is calculated on the basis of the number of printing-possible dots and a second graph B which illustrates a real developer level is different from each other, there is no developer left in the developing unit in reality in the case that ten percent of developer level is left in the first graph A (refer to a point X). At this time, if a user recognizes that there is enough developer remained and applies a printing signal, a developer replacing message is suddenly displayed to cause inconvenience to the user. That is because there is generated a difference in the amount of the developer provided on one dot due to a printing environment, the kind of a printing medium, temperature and humidity of an environment where the image forming apparatus is located, a developing voltage, a transferring voltage, and the like.

Also, in the case of an image forming apparatus in which the developer bottle and the developing unit are provided separately, a developer level sensor should be installed on the side of a developing roller because the developer level sensor can not be structurally installed on the side where the developer is supplied from the developer bottle. In this case, the developer level inside the developer bottle can not be accurately sensed on the side of the developing roller, thereby causing difficulty in calculating an accurate developer level.

SUMMARY OF THE INVENTION

The present general inventive concept provides an image forming apparatus which includes a developing unit and a separate developer bottle, and can accurately calculate a developer level through the relation between the developer level and a number of printing dots, and a developer level calculating method of the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a developer level calculating method of an image forming apparatus, the image forming apparatus including: a developing unit which comprises a developing roller which supplies a developer to a photosensitive body, a developer sensor which senses a developer level and a supplying roller which supplies the developer to the developing roller, and a developer bottle which is detachably provided to the developing unit and supplies the developer to the developing unit, the method including: calculating a number of first printing dots; sensing the developer level by using the developer sensor; supplying the developer from the developer bottle to the developing unit; calculating a number of second printing dots on the basis of the amount of the supplied developer; and calculating a number of third printing dots on the basis of the number of the first and the second printing dots, and calculating the developer level of the developer bottle on the basis of the number of the calculated third printing dots.

Here, if the sensed developer level is below a reference level, the developer may be supplied from the developer bottle.

In the calculating the number of the second printing dots on the basis of the amount of the supplied developer, the developer levels before and after the developer supply may be sensed through the developer sensor and the number of the second printing dots may be calculated on the basis of the difference between the sensed developer levels.

The method may further include displaying the developer level of the calculated developer bottle.

The developer level may be displayed on at least one of an operation panel of the image forming apparatus and a user interface UI of a host apparatus connected to the image forming apparatus.

The displayed developer level may be linearly decreased.

The number of the first printing dots may indicate the number of accumulated printing dots of the developing unit, and the number of the second printing dots may indicate the number of printing-possible dots of the developer supplied from the developer bottle.

The foregoing and/or other aspects of the present general inventive concept can also be achieved by providing an image forming apparatus which prints image data on a printing medium using a developer, including: a developing unit which includes a developing roller to provide the developer onto a photosensitive body, a developing sensor to sense a developer level, and a supplying roller to supply the developer to the developing roller; a developer bottle which supplies the developer to the developing unit; and a controller which calculates a number of first printing dots of the developing unit, converts the amount of the developer supplied from the developer bottle sensed by the developer sensor into a number of second printing dots, calculates a number of third printing dots on the basis of the number of the first printing dots and the second printing dots, and calculates a total developer level of the developer bottle on the basis of the number of the third printing dots.

The developer sensor may be provided between the developing roller and the supplying roller.

The developer bottle may supply the developer to the developing unit if the developer level inside the developing unit is below a reference level according to the sensed result of the developer sensor.

The foregoing and/or other aspects of the present general inventive concept can also be achieved by providing a developer level calculating method of a developing unit usable with an image forming apparatus, the method including calculating a number of first printing dots; sensing a developer level between a developing roller and a developer supply roller of the developing unit; supplying the developer from a developer bottle to the developing unit; calculating a number of second printing dots on the basis of the amount of the supplied developer; and calculating a number of total printing dots on the basis of the number of the first and the second printing dots, and calculating the developer level within the developer bottle on the basis of the number of the calculated total printing dots.

The method may further include supplying additional developer from the developer bottle when the sensed developer level is below a reference level.

The foregoing and/or other aspects of the present general inventive concept can also be achieved by providing a developer supply detector to detect an amount of developer remaining in a developer bottle that supplies developer to a developing unit of an image forming apparatus, the developer supply detector including a developing sensor to sense an amount of developer disposed between a developing roller and a supplying roller of a developing unit; and a controller which calculates a number of first printing dots of the developing unit, calculates a number of second printing dots from an amount of supplied developer after an image is formed on a photosensitive body of the image forming apparatus, and calculates a number of third printing dots on the basis of the number of the first printing dots and the second printing dots, and calculates a total developer level of the developer bottle on the basis of the number of the third printing dots.

The number of second printing dots can be calculated based on an amount of new developer supplied between the developing roller and the supplying roller after the image is formed.

The controller can calculate the number of first printing dots based on data provided from an image processing part of the image forming apparatus.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
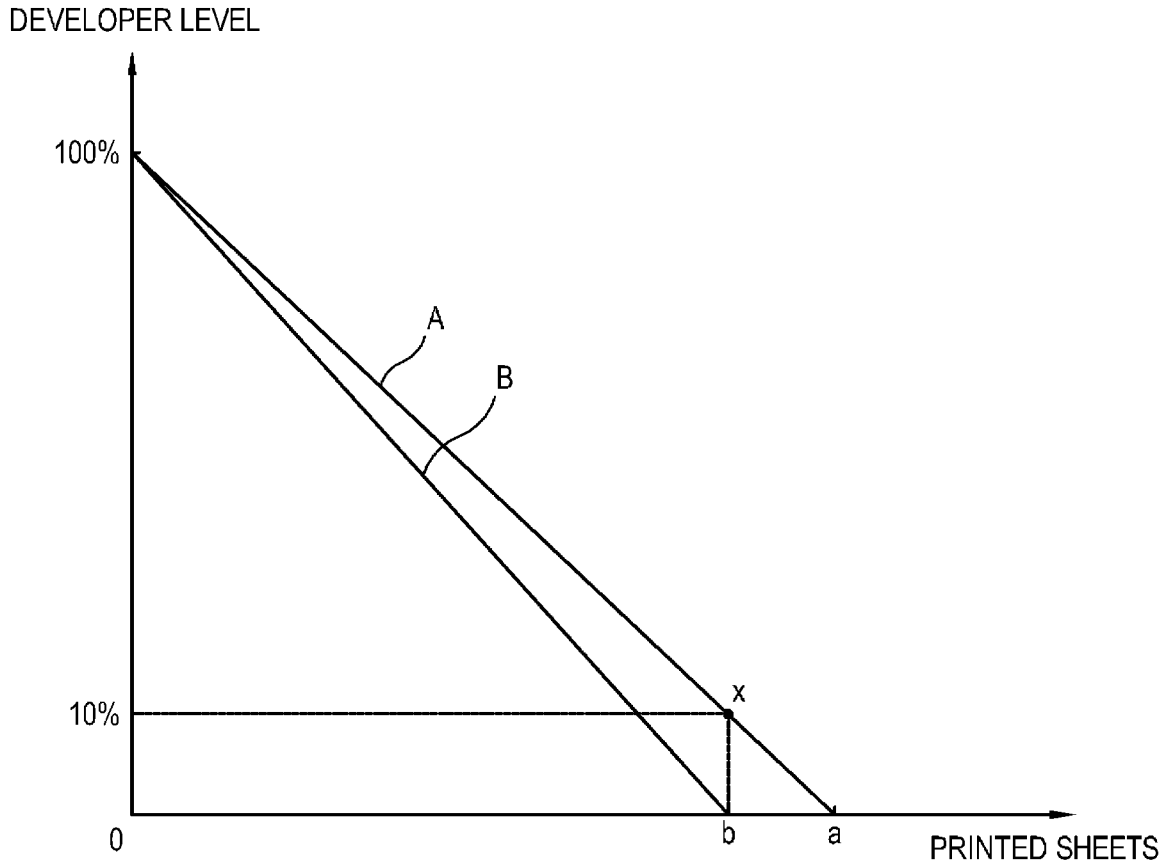
FIG. 1 is a graph illustrating a difference between a developer level based on the number of printing dots and a real developer level in a conventional image forming apparatus.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 2:
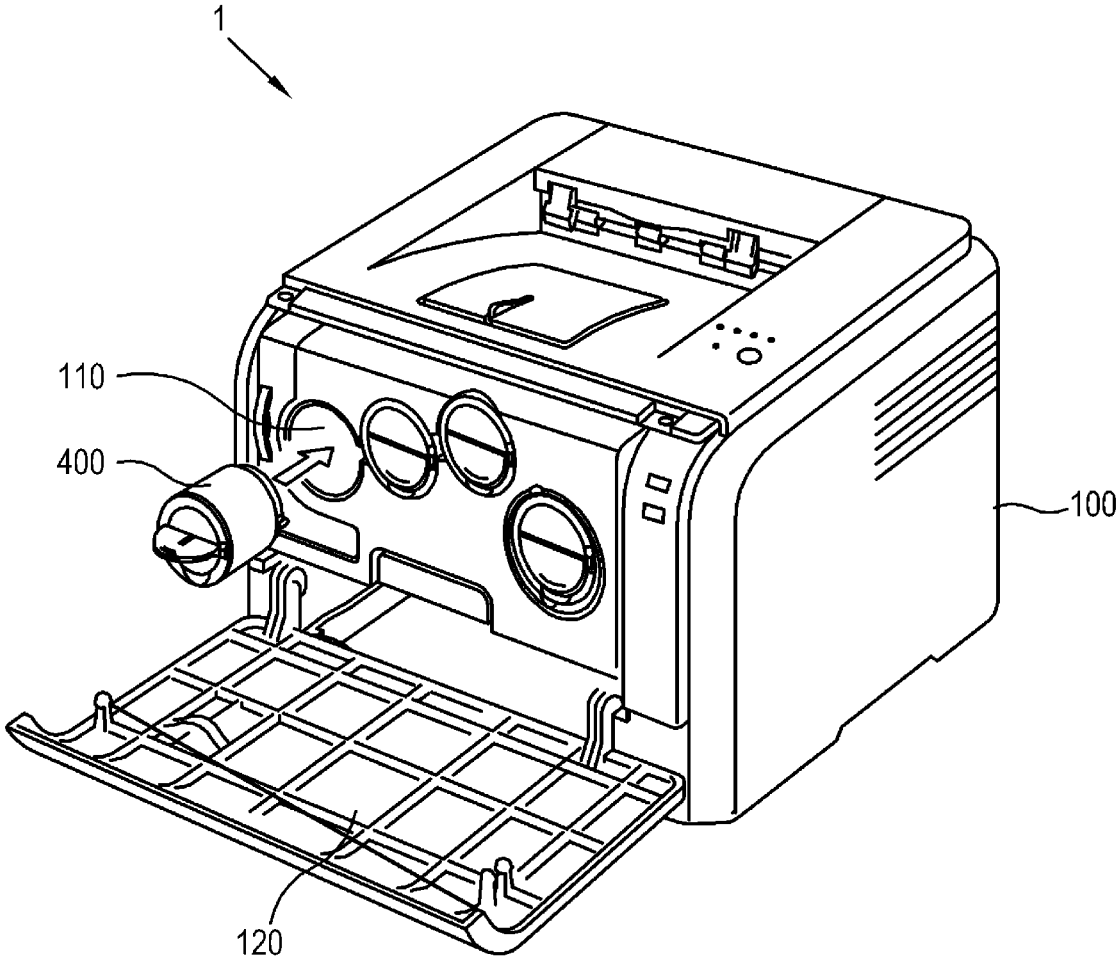
FIG. 2 is a perspective view illustrating an image forming apparatus according to an exemplary embodiment of the present general inventive concept.
Figure 3:
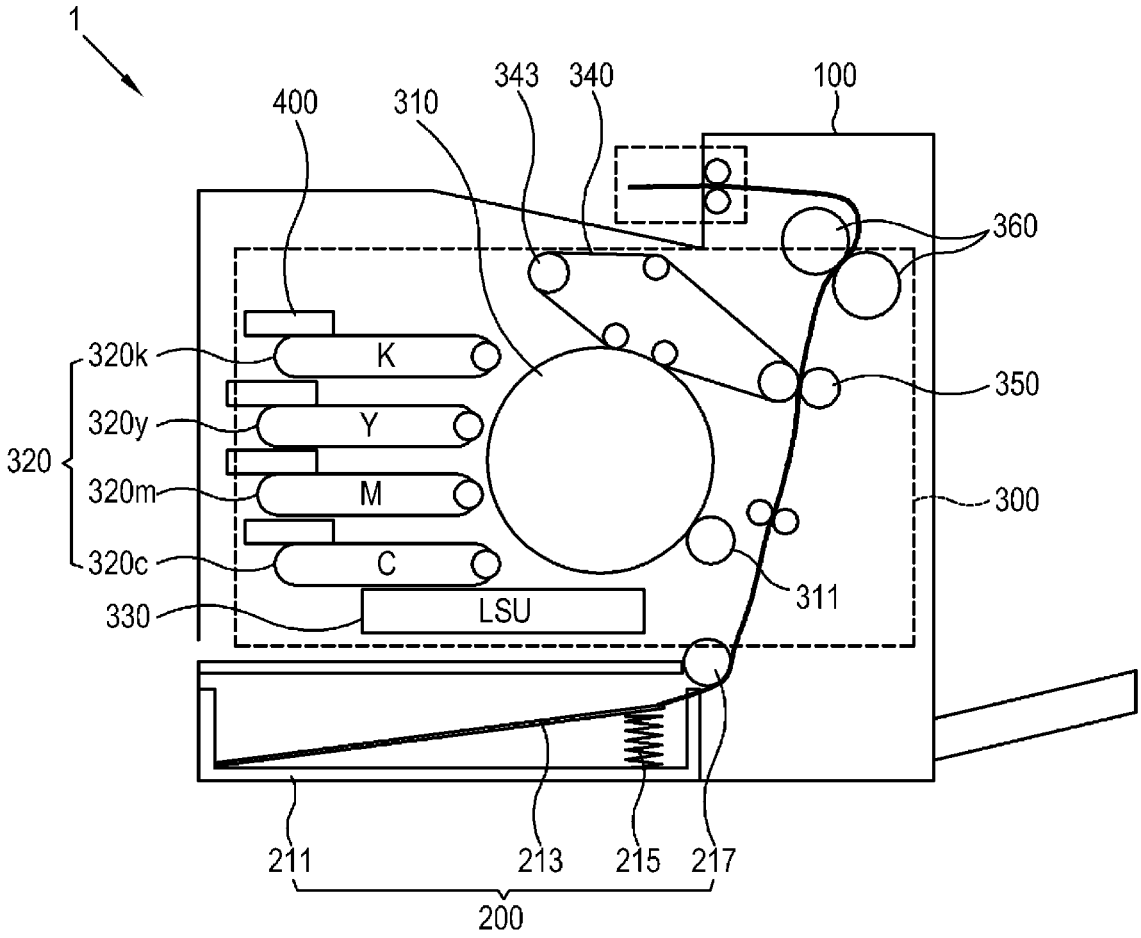
FIG. 3 is a section view illustrating the image forming apparatus in FIG. 2.

FIG. 2 is a perspective view schematically illustrating an image forming apparatus 1 according to an exemplary embodiment of the present general inventive concept, and FIG. 3 is a section view schematically illustrating the image forming apparatus 1 according to the embodiment of FIG. 2.

As illustrated in FIGS. 2 and 3, the image forming apparatus 1 includes a main body casing 100, an image forming part 300 which forms an image on a printing medium, a developer bottle 400 which supplies a developer to a developing unit 320 of the image forming part 300, an image processing part 500 (see FIG. 4) which converts image data into a printing-possible printing data, and a controller 600 which calculates a developer level of the developer bottle 400.

The main body casing 100 protects internal components from an exterior impact. The main body casing 100 includes a bottle accommodating part 110 to which the developer bottle 400 is mounted, and a front door 120 which opens to expose the bottle accommodating part 110 to the outside so that a user can replace the developer bottle 400 with a replacement developer bottle 400. The bottle accommodating part 110 supports the developer bottle 400 and the developing unit 320 to be combined with each other so as to supply a developer stably.

Also, the main body casing 100 is provided with an inputting part (not shown) through which a printing signal is applied, and a display part (not shown) which displays a printing environment, a printing operation and the developer level of the developer bottle 400. In general, the inputting part and the display part are disposed on an operation panel (not shown) on an external side of the main body casing 100.

The image forming part 300 visualizes image data to which a printing signal is applied onto a printing medium. The image forming part 300 includes a photosensitive body 310 (see FIG. 4), the developing unit 320 which provides a developer on the photosensitive body 310, an exposure part 330 which forms an electrostatic latent image on the surface of the photosensitive body 310, an intermediate transfer belt 340 to which the developer on the photosensitive body 310 is intermediately transferred, a transferring part 350 which transfers the developer of the intermediate transfer belt 340 to a printing medium, and a fusing part 360 which fuses the developer of the printing medium thereon.

The photosensitive body 310 provides a developer onto a printing medium to form an image thereon. The photosensitive body 310 is made by coating a light conductive material layer on an external circumference of a cylindrical metal drum by a method such as deposition. The light conductive material layer responds to light when it is exposed by the exposure part 330 to form an electrostatic latent image corresponding to the image data.

Meanwhile, on a side of the photosensitive body 310 is provided an electrifying roller 311 which electrifies the surface of the photosensitive body 310 to a uniform electric potential.

Figure 4:
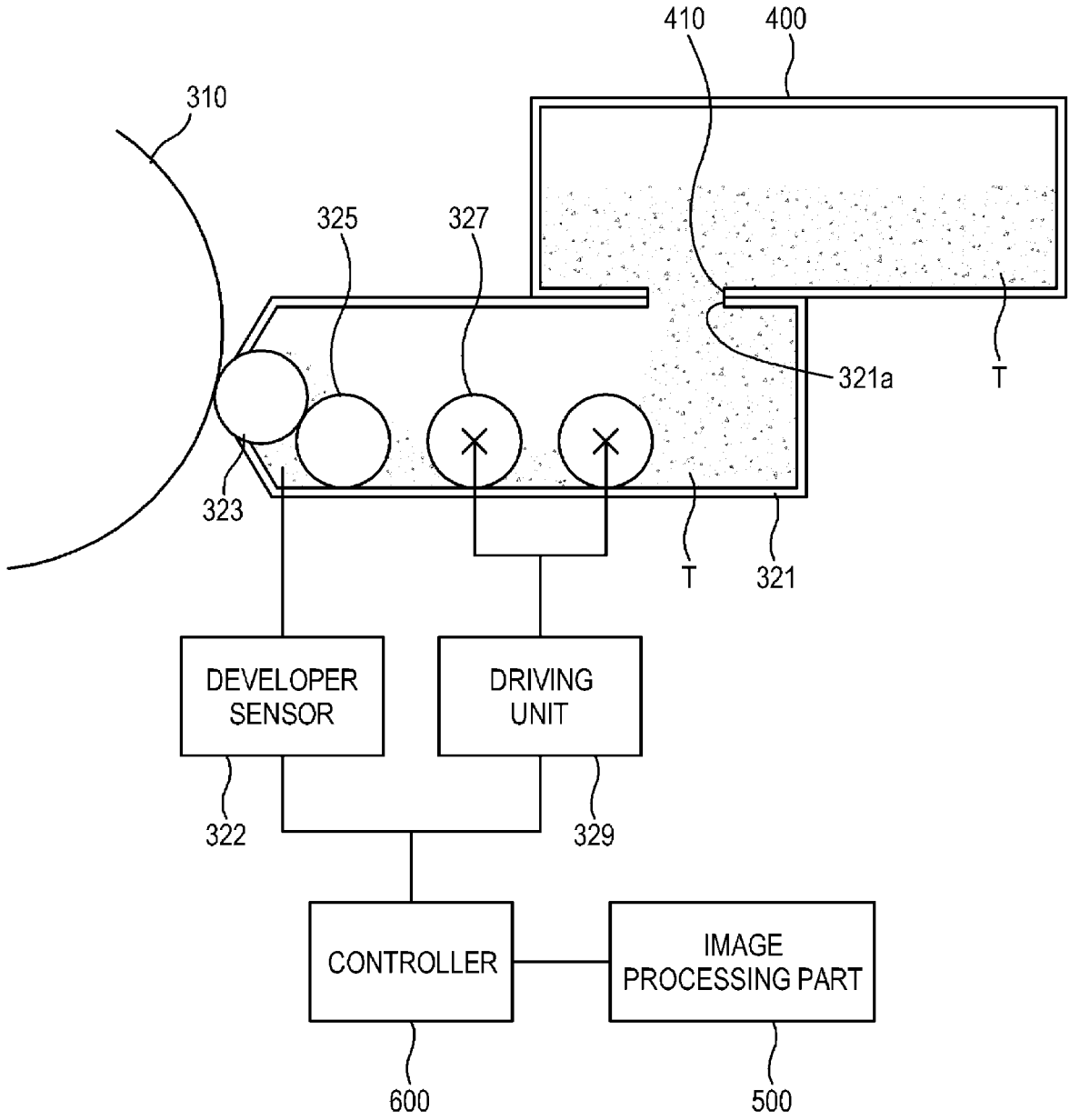
FIG. 4 is an enlarged schematic view illustrating a main part of the image forming apparatus in FIG. 2.
Figure 5A:
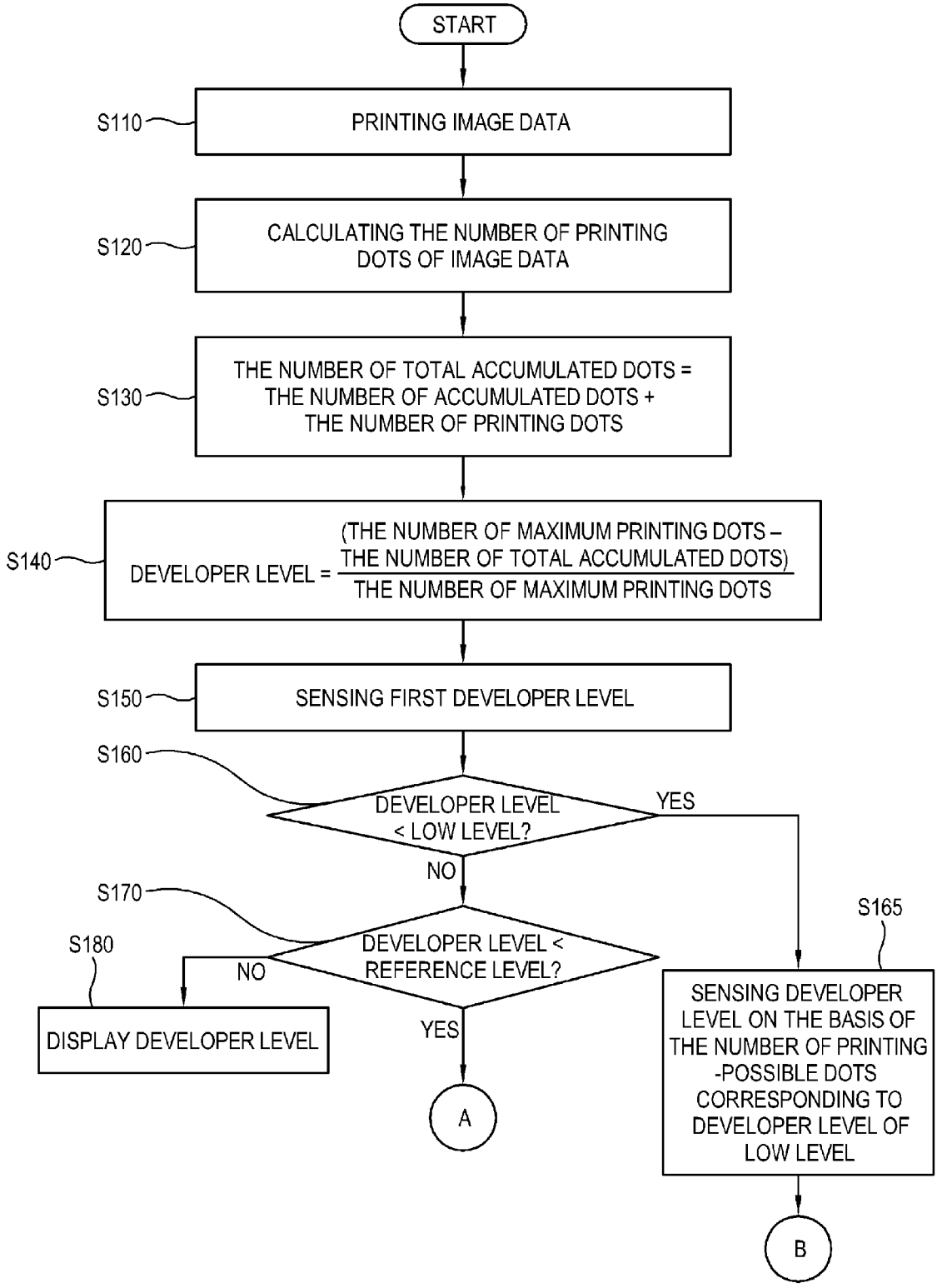
FIGS. 5A and 5B are a flow diagram illustrating a developer level calculating method of an image forming apparatus according to an exemplary embodiment of the present general inventive concept.
Figure 5B:
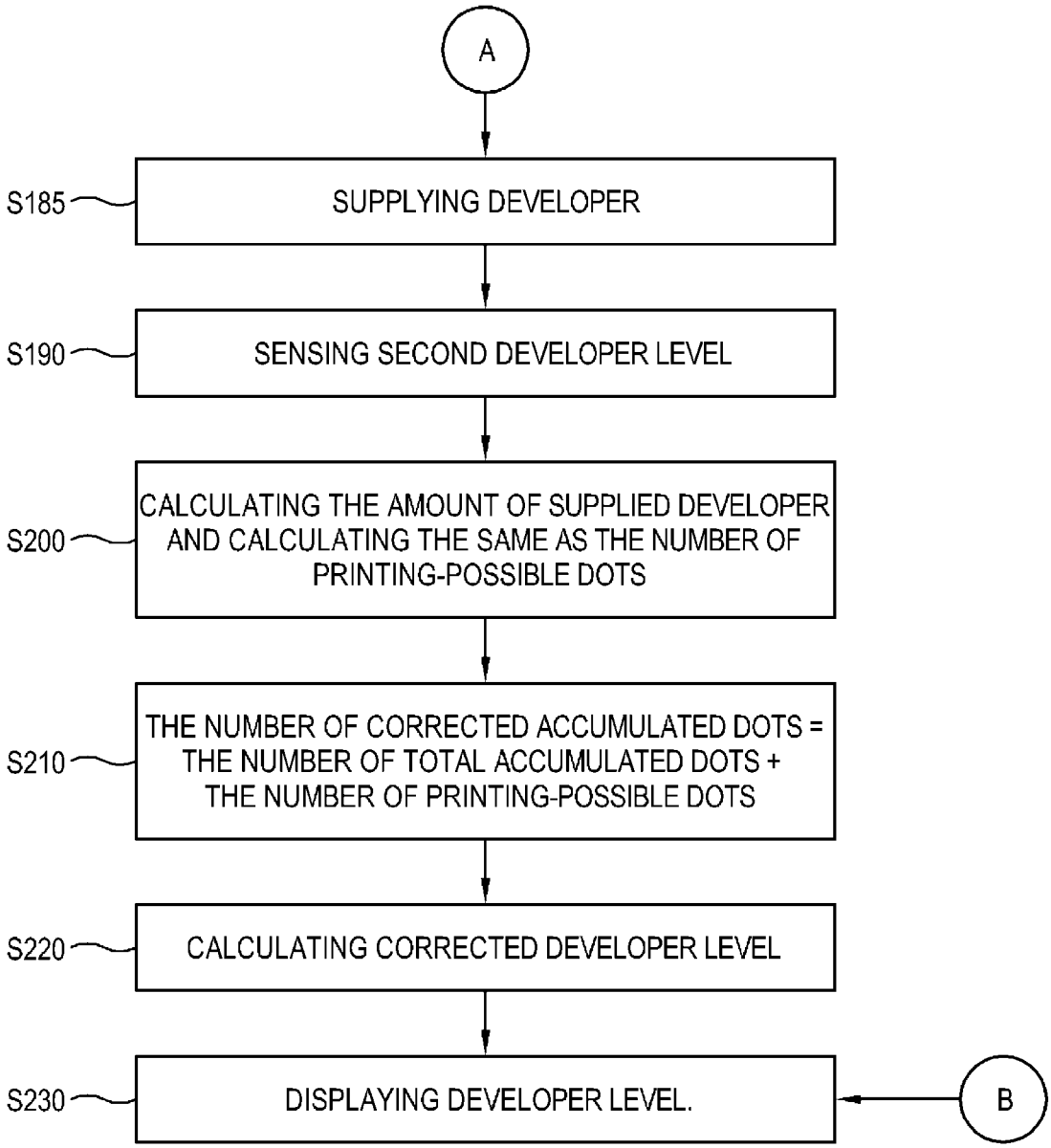

Referring to FIG. 4, the developing unit 320 includes a developing unit frame 321, a developing roller 323 which provides a developer onto the photosensitive body 310, a supplying roller 325 which supplies the developer to the developing roller 323, an auger 327 which supplies the developer supplied from the developer bottle 400 to the supplying roller 325, and a developer sensor 322 which senses the developer level inside the developing unit frame 321.

The developing unit frame 321 includes a developer inlet 321*a* which is coupled to the main body casing 100 and through which the developer is supplied from the developer bottle 400. The developing unit frame 321 may be integrated with the main body casing 100, or may be detachably mounted to the main body casing 100.

The developing roller 323 supplies the developer supplied from the supplying roller 325 to the electrostatic latent image of the photosensitive body 310. To the developing roller 323 is applied a developing voltage from a power supplying unit (not shown) so as to supply the developer on the surface thereof to the photosensitive body 310. Here, the developing voltage is higher than a surface voltage of the photosensitive body 310 generated by an electrifying voltage of the electrifying roller 311, and lower than a surface voltage of the electrostatic latent image exposed by the exposure part 330. Accordingly, the developer on the surface of the developing roller 323 becomes attached to the electrostatic latent image of the photosensitive body 310 by a potential difference.

The supplying roller 325 supplies a developer supplied from the auger 327 toward the developing roller 323. The supplying roller 325 rotates in contact with the developing roller 323 to attach the developer to the developing roller 323 by a frictional electrification.

The auger 327 transfers the developer, input from the developer bottle 400 by self-weight, toward the supplying roller 325. The auger 327 may have a plurality of rotating blades along a rotating shaft so that the developer can move easily. The auger 327 may be provided in plural in consideration of the size of the developing unit 320 and the distance from the developer inlet 321*a* to the developing roller 323.

The supplying roller 325 and the auger 327 are driven by a driving force from a driving unit 329. The developing roller 323, the supplying roller 325 and the auger 327 may be connected with each other by a gear train to rotate together, or may be driven by different driving forces. At this time, the amount of the developer supplied to the developing roller 323 may be calculated by a driving time of the driving unit 329.

The developer sensor 322 is provided between the developing roller 323 and the supplying roller 325 to sense the developer level between the developing roller 323 and the supplying roller 325 and inform the controller 600 of the sensed result. The developing sensor 322 senses the developer level stored between the developing roller 323 and the supplying roller 325 so that the amount of the developer provided from the developing roller 323 to the photosensitive body 310 can be uniformly maintained. Here, if the amount of the developer stored between the developing roller 323 and the supplying roller 325 is a small amount, a small amount of developer is supplied from the supplying roller 325 to the developing roller 323, and as a result, only a small amount of developer can be provided to the electrostatic latent image formed on the photosensitive body 310, and thus, a blurred image is formed on the printing medium.

Accordingly, the developer sensor 322 enables the developer level between the developing roller 323 and the supplying roller 325 to be maintained over a reference level so as to maintain resolution of a printed image over a reference resolution.

The developer level between the supplying roller 325 and the developing roller 323 is divided into the reference level and a low level, and then is sensed by the developer sensor 322. The reference level indicates a minimum developer level capable of maintaining the reference resolution, and the low level indicates a developer level to estimate that there is not enough developer left in the developer bottle 400 to maintain the reference resolution.

The developer sensor 322 sends a signal to the controller 600 so that a developer can be supplied from the supplying roller 325 and the auger 327 if the developer level is below the reference level according to the sensed result. Also, the developer sensor 322 senses a secondary developer level to calculate the amount of the supplied developer after the developer is supplied from the supplying roller 325. Also, the developer sensor 322 informs the controller 600 of the amount of the calculated supplied developer.

The developer sensor 322 may be provided as a light sensor which senses the level of the developer using a light-emitting part and a light-receiving part, or as a weight sensor which senses the weight of the developer to calculate the developer level, or the like. Here, if the developer sensor 322 is provided as the light sensor, the light sensor may be provided to measure a variety of levels inside the developing unit.

The exposure part 330 scans a beam onto the photosensitive body 310 according to image data transmitted from the image processing part 500 to form an electrostatic latent image thereon. The exposure part 330 forms an electrostatic latent image corresponding to a predetermined size of a spot according to the size of a light source. If a developer is provided onto the spot, this spot becomes one dot of developer.

The developer bottle 400 detachably couples to the developing unit 320 and supplies the developer therein to the developing unit 320. As illustrated in FIG. 4, the developer bottle 400 includes an outlet 410 through which a developer is discharged, and a shutter (not shown) which opens the outlet 410 when the developer bottle 400 is mounted to the bottle accommodating part 110. The developer bottle 400 supplies the developer to the developing unit 320 by self-weight of the developer loaded inside. The developer bottle 400 may be provided to have an inclined bottom so that the developer can be more easily discharged.

The image processing part 500 converts image data into a printing-possible printing data if a printing signal is applied with respect to the image data. The printing data is represented as a signal of bit units so that the exposure part 330 can form an electrostatic latent image onto the photosensitive body 310 through an on/off operation of the light source. Here, one singular signal, when an on signal is applied to the light source, may be determined to be one dot. Accordingly, the number of total printing dots with respect to the image data can be calculated by the printing data converted in the image processing part 500.

The controller 600 calculates the developer level of the developer bottle 400 on the basis of the calculated number of printing dots (calculated by the converted printing data) transmitted from the image processing part 500 and the amount of developer detected by the developer sensor 322. The controller 600 calculates the number of maximum printing-possible dots (MC) on the basis of the number of the printing-possible dots per the reference amount of the developer if the developer bottle 400 is mounted to the main body casing 100. Also, whenever a printing operation with respect to image data is completed, the controller 600 accumulates the number of the printing dots received from the image processing part 500 to calculate the number of accumulated printing dots (AC), and calculates a value obtained by dividing the difference between a number of maximum printing-possible dots (MC) and the number of the accumulated printing dots (AC) by the number of the maximum printing-possible dots (MC) as a developer quantity (DQ) (that is, DQ=(MC−AC)/MC).

Meanwhile, the controller 600 compensates for the difference between the real amount of the developer inside the developer bottle 400 and the developer quantity (DQ) calculated on the basis of the number of the accumulated printing dots (AC). For this purpose, the controller 600 calculates the supply amount of the developer supplied toward the developing roller 323 by the supplying roller 325 as the number of the printing-possible dots (PPC), and adds the number of the calculated printing-possible dots (PPC) to a number of the total accumulated printing dots (DC) (the total accumulated printing dots (DC) is determined by adding the number of accumulated printing dots (AC) and the number of printing dots (PC) as a result of a newly printed image on a printing medium, the number of printing dots (PC) being provided to the controller 600 from the image processing part 500). This is because there is a difference between the real developer level and the developer level calculated based on the number of the accumulated printing dots since more developer is used in reality than the amount of the developer calculated to be used per the reference amount of the developer. Thus, it is necessary to compensate for the difference by calculating the developer supplied to the developing roller 323 as the amount used on the basis of the developer bottle 400.

Hereinafter, a developer level calculating method of the image forming apparatus 1 according to an embodiment of the present general inventive concept will be described while referring to FIGS. 3 to 6.

First, if a printing signal with respect to image data is applied to the image forming apparatus 1, the image forming part 300 converts the image data onto a printing medium (operation S110).

Then, the image processing part 500 calculates the number of printing dots (PC) from the printing data converted from the image data, and informs the controller 600 of the number of the calculated printing dots (PC) (operation S120).

The controller 600 adds the number of the printing dots (PC) received from the image processing part 500 to the number of accumulated printing dots (AC) to calculate the number of total accumulated printing dots (DC) (operation S130).

Then, the controller 600 divides a value obtained by subtracting the number of the calculated total accumulated printing dots (DC) from the number of the maximum printing-possible dots (MC) of the developer bottle 400 by the number of the maximum printing-possible dots (MC) to calculate a developer quantity (or level) as a percentage unit (operation S140).

Meanwhile, after the developing roller 323 provides a developer onto the photosensitive body 310, the developer sensor 322 senses a first developer quantity (DQ) between the developing roller 323 and the supplying roller 325 for a succeeding printing operation (operation S150).

The developer sensor 322 determines whether the sensed first developer quantity is lower than the preset low level (operation S160). Here, if the first developer level is lower than the preset low level, this indicates that there is no more supply of the developer from the supplying roller 325. Accordingly, the sensed first developer level becomes the entire total developer level of the developer bottle 400 and the developing unit 320.

If the first developer level is lower than the preset low level, the developer sensor 322 informs the controller 600 of the result. Then, the controller 600 calculates the number of the printing-possible dots corresponding to the first developer level, and calculates a developer level on the basis of the number of the calculated printing-possible dots (operation S165). For instance, if the low level is 10 percent, the developer level calculated on the basis of the number of the printing dots is 15 percent, but if the developer level is 9 percent, the 9 percent is displayed as a developer level.

In contrast, if the first developer level sensed in the developer sensor 322 is higher than the preset low level, the developer sensor 322 determines whether the sensed first developer level is lower than the reference level (operation S170). The reference level refers to a minimum developer level which can sufficiently provide the reference resolution. If the first developer level is between the reference level and the preset low level, the developer sensor 322 sends a signal to the controller 600, and the controller 600 drives the driving part 329 so that the supplying roller 325 and the auger 327 can supply a developer to the developing roller 323 (operation S185).

At this time, if the developer is supplied to the developing roller 323 through the auger 327 and the supplying roller 325, the same volume of developer as that of the supplied developer is input from the developer bottle 400 through the outlet 410 and the developer inlet 321*a* to the developer unit frame 321. At this time, the amount of the supplied developer can be controlled through a driving time of the driving part 329.

If the developer is supplied, the developer sensor 322 senses a second developer level, and informs the controller 600 of the result of the sensed second developer level (operation S190).

The controller 600 determines the relation between the number of the printing dots and the developer level on the basis of the sensed amount of the supplied developer received from the developer sensor 322 (operation S200).

That is, the controller 600 calculates the number of the printing-possible dots (PPC) using the sensed amount of the supplied developer, and adds the number of the calculated printing-possible dots (PPC) to the number of the pre-calculated total accumulated printing dots (DC) to calculate a number of corrected accumulated printing dots (CAC) (operation S210).

Then, the controller 600 calculates a corrected developer quantity (CDQ) on the basis of the number of the corrected accumulated printing dots (CAC) (operation S220).

In other words, the controller 600 interprets the amount of the developer supplied from the supplying roller 325 as a consumed developer quantity, and corrects the difference value between the real consumed developer and the developer quantity calculated on the basis of the number of the printing dots.

Figure 6:
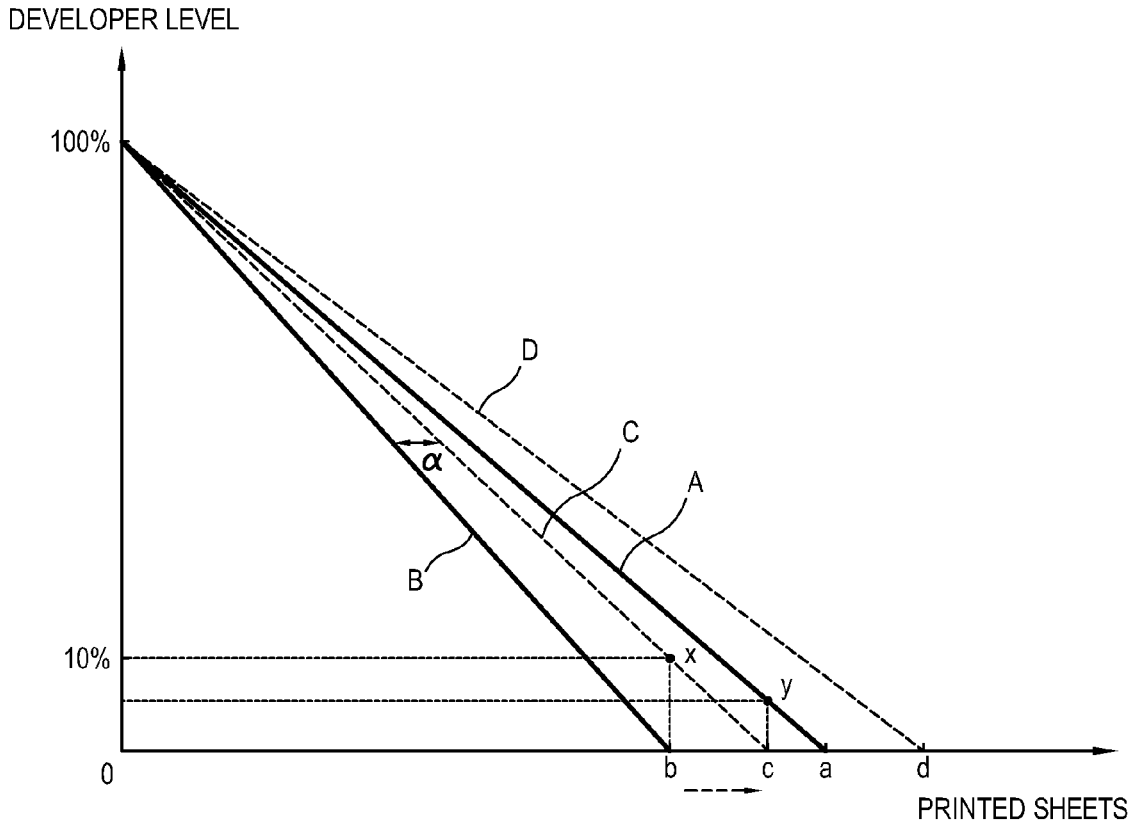
FIG. 6 is a graph illustrating a developer level calculated by the image forming apparatus according to an exemplary embodiment of the present general inventive concept and a developer level based on the number of the printing dots.

In this case, as illustrated in FIG. 6, a graph C representing the corrected developer level is located between a graph A representing the developer level calculated on the basis of the number of the printing dots and a graph B representing the real consumed developer quantity. Accordingly, a conventional difference (a–b) between a number of printed sheets (b) in which the developer quantity is consumed in reality and a number of printed sheets (a) calculated on the basis of the number of the printing dots is decreased to a new amount represented by a difference (a–c), which is a difference between a number of printed sheets (c) in which the developer level is corrected and the number of printed sheets (a) calculated on the basis of the number of the printing dots.

Meanwhile, the controller 600 displays the developer level of the developer bottle 400 calculated through the above processes on a display part (not shown) or a user interface UI of a host apparatus (not shown) connected to the image forming apparatus so that a user can recognize the developer level.

A color image forming apparatus has been described above as an exemplary embodiment of the present general inventive concept, but the present general inventive concept may also be applied to a mono color image forming apparatus.

As described above, a developer level based on a number of the printing dots is corrected on the bases of a developer quantity supplied from a supplying roller, but it may be corrected by adding a predetermined number of printing dots to the number of accumulated dots according to a printing density selected through an input part by a user, as necessary.

As described above, in the image forming apparatus according to the exemplary embodiments of the present general inventive concept, the amount of a developer supplied from a developer cartridge is converted into a number of printing-possible dots and is regarded as a consumed developer quantity to calculate the developer level, thereby calculating a developer level to more accurately indicate a real consumed developer quantity.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developer level calculating method of an image forming apparatus, the image forming apparatus comprising: a developing unit which comprises a developing roller which supplies a developer to a photosensitive body, a developer sensor which senses a developer level and a supplying roller which supplies the developer to the developing roller, and a developer bottle which is detachably provided to the developing unit and supplies the developer to the developing unit, the method comprising:

calculating a number of first printing dots;

sensing the developer level by using the developer sensor;

supplying the developer from the developer bottle to the developing unit;

calculating a number of second printing dots on the basis of the amount of the supplied developer; and calculating a number of third printing dots on the basis of the number of the first and the second printing dots, and calculating the developer level of the developer bottle on the basis of the number of the calculated third printing dots.

2. The method according to claim 1, further comprising:

if the sensed developer level is below a reference level, supplying more developer from the developer bottle.

3. The method according to claim 2, wherein in the calculating the number of the second printing dots on the basis of the amount of the supplied developer, the developer levels before and after the developer supply are sensed through the developer sensor and the number of the second printing dots is calculated on the basis of the difference between the sensed developer levels.

4. The method according to claim 3, further comprising:

displaying the developer level of the calculated developer bottle.

5. The method according to claim 4, wherein the developer level is displayed on at least one of an operation panel of the image forming apparatus and a user interface UI of a host apparatus connected to the image forming apparatus.

6. The method according to claim 5, wherein the displayed developer level is linearly decreased.

7. The method according to claim 2, further comprising:

displaying the developer level of the calculated developer bottle.

8. The method according to claim 7, wherein the developer level is displayed on at least one of an operation panel of the image forming apparatus and a user interface UI of a host apparatus connected to the image forming apparatus.

9. The method according to claim 8, wherein the displayed developer level is linearly decreased.

10. The method according to claim 1, further comprising:

displaying the developer level of the calculated developer bottle.

11. The method according to claim 10, wherein the developer level is displayed on at least one of an operation panel of the image forming apparatus and a user interface UI of a host apparatus connected to the image forming apparatus.

12. The method according to claim 11, wherein the displayed developer level is linearly decreased.

13. The method according to claim 1, wherein the number of the first printing dots indicates the number of accumulated printing dots of the developing unit, and the number of the second printing dots indicates the number of printing-possible dots of the developer supplied from the developer bottle.

14. An image forming apparatus which prints image data on a printing medium using a developer, the image forming apparatus comprising:

a developing unit which comprises a developing roller to provide the developer onto a photosensitive body, a developing sensor to sense a developer level, and a supplying roller to supply the developer to the developing roller;

a developer bottle which supplies the developer to the developing unit; and a controller which calculates a number of first printing dots of the developing unit, converts the amount of the developer supplied from the developer bottle sensed by the developer sensor into a number of second printing dots, calculates a number of third printing dots on the basis of the number of the first printing dots and the second printing dots, and calculates a total developer level of the developer bottle on the basis of the number of the third printing dots.

15. The image forming apparatus according to claim 14, wherein the developer sensor is disposed between the developing roller and the supplying roller.

16. The image forming apparatus according to claim 15, wherein the developer bottle supplies the developer to the developing unit if the developer level inside the developing unit is determined to be below a reference level according to the sensed result of the developer sensor.

17. A developer level calculating method of a developing unit usable with an image forming apparatus, the method comprising:

calculating a number of first printing dots;

sensing a developer level between a developing roller and a developer supply roller of the developing unit;

supplying the developer from a developer bottle to the developing unit;

calculating a number of second printing dots on the basis of the amount of the supplied developer; and calculating a number of total printing dots on the basis of the number of the first and the second printing dots, and calculating the developer level within the developer bottle on the basis of the number of the calculated total printing dots.

18. The method according to claim 17, further comprising:

supplying additional developer from the developer bottle when the sensed developer level is below a reference level.

19. The method according to claim 17, wherein the number of first printing dots is calculated from print data converted from image data.

20. A developer supply detector to detect an amount of developer remaining in a developer bottle that supplies developer to a developing unit of an image forming apparatus, the developer supply detector comprising:

a developing sensor to sense an amount of developer disposed between a developing roller and a supplying roller of a developing unit; and a controller which calculates a number of first printing dots of the developing unit, calculates a number of second printing dots from an amount of supplied developer after an image is formed on a photosensitive body of the image forming apparatus, and calculates a number of third printing dots on the basis of the number of the first printing dots and the second printing dots, and calculates a total developer level of the developer bottle on the basis of the number of the third printing dots.

21. The developer supply detector of claim 20, wherein the number of second printing dots is calculated based on an amount of new developer supplied between the developing roller and the supplying roller after the image is formed.

22. The developer supply detector of claim 21, wherein the controller calculates the number of first printing dots based on data provided from an image processing part of the image forming apparatus.

23. A developer level calculating method of a developing unit usable with an image forming apparatus, the method comprising:

calculating a number of first printing dots with a controller of the image forming apparatus;

sensing a developer level with a developer sensor; and calculating a number of second printing dots with the controller according to developer levels before and after the developer supply are sensed with the developer sensor by calculating the difference between the sensed developer levels.

24. An image forming apparatus which prints image data on a printing medium using a developer, the image forming apparatus comprising:

a developing unit having a developing roller to provide the developer onto a photosensitive body, a developing sensor to sense a developer level, and a supplying roller to supply the developer to the developing roller; and a controller to calculate a number of first printing dots and to calculate a number of second printing dots according to developer levels before and after the developer supply are sensed with the developing sensor by calculating the difference between the sensed developer levels.

* * * * *